US007917076B2

(12) United States Patent
Inoue

(10) Patent No.: US 7,917,076 B2
(45) Date of Patent: Mar. 29, 2011

(54) TONER CONVEYING DEVICE AND IMAGE FORMING APPARATUS

(75) Inventor: Mitsumi Inoue, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 10 days.

(21) Appl. No.: 12/615,443

(22) Filed: Nov. 10, 2009

(65) Prior Publication Data

US 2010/0189483 A1 Jul. 29, 2010

(30) Foreign Application Priority Data

Jan. 29, 2009 (JP) ..... 2009-018420

(51) Int. Cl.
*G03G 21/10* (2006.01)

(52) U.S. Cl. ..... 399/358; 399/359

(58) Field of Classification Search ..... 399/256, 399/258, 263, 358–360
See application file for complete search history.

(56) References Cited

U.S. PATENT DOCUMENTS 4,297,021 A * 10/1981 Tani et al. ..... 399/358
5,659,870 A * 8/1997 Takahara et al. ..... 399/359

FOREIGN PATENT DOCUMENTS

JP 09-073219 3/1997
JP 09-160360 6/1997

* cited by examiner

*Primary Examiner* — Hoang Ngo
(74) *Attorney, Agent, or Firm* — K&L Gates LLP

(57) ABSTRACT

A toner conveying device includes a pipe body (conveying pipe) having an inside diameter thereof that is modified in a pipe-axis direction and a screw member coaxially located in the pipe body for feeding the toner. The screw member includes a screw shaft that rotates about an axis and a spiral fin that is spirally formed around an outer circumferential surface of the screw shaft. The distance between an outer circumferential surface of the spiral fin and an inner circumferential surface of the pipe body is constant in the longitudinal direction of the pipe body.

11 Claims, 12 Drawing Sheets

TONER CONVEYING DEVICE AND IMAGE FORMING APPARATUS

INCORPORATION BY REFERENCE

This application is based upon and claims the benefit of priority from the corresponding Japanese Patent application No. 2009-018420, filed Jan. 29, 2009, the entire contents of which are incorporated herein by reference.

BACKGROUND

1. Field of the Invention

The present invention relates to a toner conveying device used to feed toner in an image forming apparatus including, for example, an image bearing member that forms a toner image on the surface thereof. The present invention also relates to a cleaning device for cleaning the surface of the image bearing member, including the toner conveying device, and to an image forming apparatus using the toner conveying device or the cleaning device.

2. Description of the Related Art

Conventionally, a developing device of an image forming apparatus uses a toner conveying device for feeding toner. The toner conveying device includes, for example, a tubular conveying pipe having an inner diameter that gradually decreases from the upstream side toward the downstream side and a conveying screw that is concentrically arranged in the conveying pipe so as to be rotatable.

The inside and outside diameters of the conveying pipe gradually decrease toward the downstream side. In this structure, toner fed through the conveying pipe toward the downstream side is compressed, on the downstream side, due to the rotation of the conveying screw about the axis. Friction caused by the compression charges the carrier, which is made of synthetic resin and is located in the toner, increasing the charge level of the toner deposited on the carrier. This increase in the charge level creates a smooth toner image on the circumferential surface of the photosensitive drum.

Furthermore, conventionally, it is known to use as a toner conveying device in the developing device of the image forming apparatus, a toner conveying device that has a conveying screw for feeding toner in a housing, a portion of the conveying screw corresponding to a toner supply port in the housing having an outside diameter that is slightly larger than that of the other portions or a screw pitch that is slightly larger than that of the other portions. This structure increases the feeding speed of the toner near the toner supply port when the toner is supplied to the developing device through the toner supply port, thereby preventing the toner from staying. Thus, the supply of toner to the device is smoothly performed.

In this type of toner conveying device, both the inside diameter of the conveying pipe and the outside diameter of the conveying screw gradually decrease toward the downstream side. However, the purpose of such a structure is not to prevent toner from sticking to the inner wall surface of the pipe or to make the amount of toner fed uniform, but to compress the toner on the downstream side to increase the charging level.

In these toner conveying devices, the conveying screw has a large diameter only near the toner supply port of the housing of the developing device. Countermeasures against toner sticking to the bottom of the housing at other portions or to achieve a uniform conveyance of toner are not considered by these devices. Therefore, there is a problem in that toner may deposit on and stick to the bottom of the housing on the upstream side of the toner supply port, making a smooth conveyance of toner difficult.

SUMMARY

The present invention provides a toner conveying device capable of preventing the partial deposition and sticking of toner in the conveying pipe and of stably feeding toner and an image forming apparatus using the toner conveying device.

A toner conveying device according to an embodiment of the present invention includes: a conveying pipe for feeding toner, an inside diameter thereof changing in a pipe-axis direction; and a conveying screw coaxially arranged in the conveying pipe, the conveying screw feeds toner by rotating about its axis. The conveying screw includes a screw shaft that rotates about the axis, and a spiral fin that is formed spirally around the outer circumferential surface of the screw shaft. The distance between the outer circumferential surface of the spiral fin and the inner circumferential surface of the conveying pipe is substantially constant in the pipe-axis direction.

Additional features and advantages are described herein, and will be apparent from the following Detailed Description and the figures.

BRIEF DESCRIPTION OF THE FIGURES

In the accompanying drawings:

FIG. 3A illustrates a state immediately before a waste-toner discharging pipe is connected to a waste-toner collecting pipe, and FIG. 3B illustrates a state in which the waste-toner discharging pipe is connected to the waste-toner collecting pipe.

FIG. 4A illustrates a state immediately before the waste-toner discharging pipe is connected to the waste-toner collecting pipe, and FIG. 4B illustrates a state in which the waste-toner discharging pipe is connected to the waste-toner collecting pipe.

FIG. 9A illustrates a state immediately before the waste-toner discharging pipe of the belt cleaning device is connected to a waste-toner receiving member of the toner collection unit, and FIG. 9B illustrates a state in which the waste-toner discharging pipe of the belt cleaning device is connected to the waste-toner receiving member of the toner collection unit.

FIG. 10A illustrates a state immediately before the waste-toner discharging pipe of the belt cleaning device is connected to the waste-toner receiving member of the toner collection unit, and FIG. 10B illustrates a state in which the waste-toner discharging pipe of the belt cleaning device is connected to the waste-toner receiving member of the toner collection unit.

FIG. 11A illustrates the toner conveying device according to one embodiment, FIG. 11B illustrates the toner conveying device according to another embodiment, and FIG. 11C illustrates the toner conveying device according to a still another embodiment.

DETAILED DESCRIPTION

Figure 1:
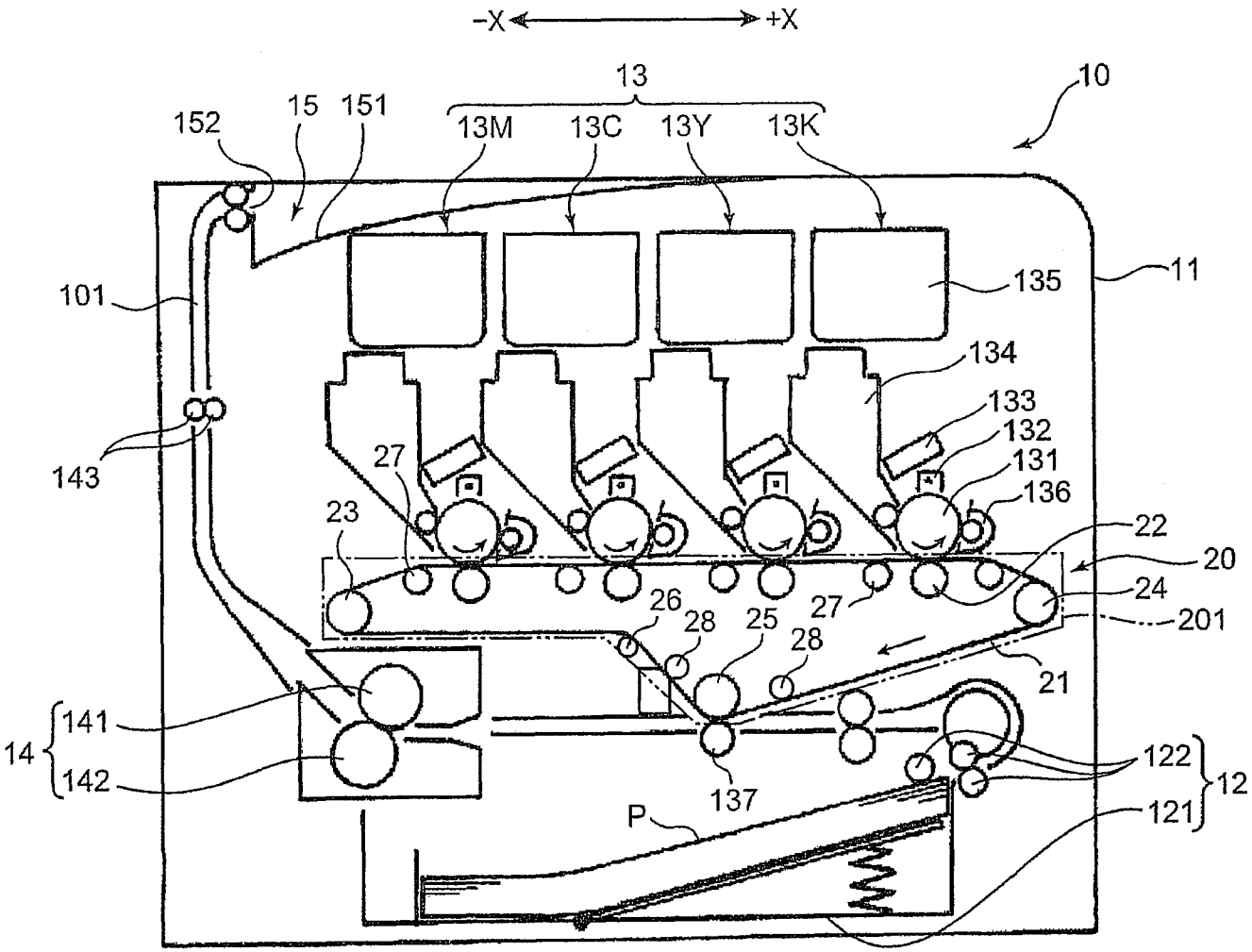
FIG. 1 is a sectional view illustrating the internal structure of an embodiment of the image forming apparatus, including a cleaning device having a toner conveying device of the present invention.

Embodiments of the present invention will be described below with reference to the attached drawings. FIG. 1 is a sectional view illustrating the internal structure of an image forming apparatus according to an embodiment, which employs a cleaning device having a toner conveying device of the present invention. In FIG. 1, the X direction refers to a left-right direction, more specifically, "the –X" direction references the left and "the +X" direction references the right. In this embodiment, the image forming apparatus is a printer 10.

As illustrated in FIG. 1, the printer 10 includes a printer body 11, a sheet feeding section 12 that stores sheets P, an image forming section 13 for transferring toner images to the sheet P fed from the sheet feeding section 12, a fixing section 14 for fixing the toner image that was transferred to the sheet P in the image forming section 13, and a sheet-output section 15 that outputs the sheet P that have undergone the fixing process in the fixing section 14.

The sheet feeding section 12 includes a sheet cassette 121, that is removably attached to the lower part of the printer body 11, and can store a plurality of sheets P, and pick-up rollers 122 that are located at the upper right of the sheet cassette 121 in FIG. 1. The sheets P that are stored in the sheet cassette 121 are picked up, one at a time, by the pick-up rollers 122 and are fed to the image forming section 13.

The image forming section 13 forms toner images on the sheet P fed from the sheet feeding section 12. In this embodiment, the image forming section 13 includes, from the upstream (left in FIG. 1) side to the downstream side, a magenta unit 13M that uses magenta toner, a cyan unit 13C that uses cyan toner, a yellow unit 13Y that uses yellow toner, and a black unit 13K that uses black toner.

These units 13M, 13C, 13Y, and 13K, positioned above an intermediate transfer unit 20, each include a photosensitive drum (image bearing member) 131, a charger 132, an exposure device 133, a developing device 134, and a toner container 135.

The photosensitive drum 131 forms an electrostatic latent image and a toner image according to the electrostatic latent image on the circumferential surface thereof. The photosensitive drum 10 is coaxially supported with a drum shaft that extends in a front-rear direction (the direction perpendicular to the plane of the sheet of FIG. 1) so as to be rotatable about the shaft.

In this embodiment, the chargers 132 have charging wires. The discharge from the charging wires charges the circumferential surfaces of the photosensitive drums 131, forming a uniform charge thereon.

The exposure devices 133 irradiate the circumferential surfaces of the photosensitive drums 131, which are uniformly charged by the chargers 132, using laser beams according to image information to form electrostatic latent images.

The developing devices 134 supply toner to the circumferential surfaces of the photosensitive drums 131, where the electrostatic latent images are formed, thereby forming toner images.

The toner containers 135 are removably attached to the developing devices 134 to supply toner to the developing devices 134.

The drum cleaning devices 136 remove waste toner from the circumferential surfaces of the photosensitive drums 131.

The intermediate transfer unit 20 is positioned below the photosensitive drums 131 of the units 13M, 13C, 13Y, and 13K and includes an intermediate transfer belt 21, on which the toner images formed on the circumferential surfaces of the photosensitive drums 131 are superimposed to form a color image. The intermediate transfer unit 20 includes an intermediate frame 201, illustrated by a two-dot broken line in FIG. 1, that moves in the front-rear direction (the direction perpendicular to the plane of the sheet of FIG. 1) and is removably attached to the printer body 11.

The intermediate transfer unit 20 has a belt cleaning device 30 that removes residual waste toner thereby cleaning the surface.

Primary transfer rollers 22 are located opposite the photosensitive drums 131 with the intermediate transfer belt 21 therebetween. Bias voltages applied to the primary transfer rollers 22 electrically transfer the toner images on the photosensitive drums 131 to the surface of the intermediate transfer belt 21.

A secondary transfer roller 137 for electrically transferring the color toner image on the intermediate transfer belt 21 to the sheet P, fed from the sheet feeding section 12, is positioned at the lower part of the intermediate transfer belt 21 in FIG. 1.

The photosensitive drums 131 rotate counterclockwise in FIG. 1 and receive toner from the corresponding developing devices 134.

The chargers 132 include charging wires through which a power source (not shown) supplies a high voltage. Corona discharge from the wires uniformly charges the circumferential surfaces of the photosensitive drums 131. Instead of using the chargers 132, the circumferential surfaces of the photosensitive drums 131 may be charged by being contacted by the charging rollers, to which a high voltage is applied.

The exposure devices 133 irradiate the circumferential surfaces of the photosensitive drums 131, which are uniformly charged by the chargers 132, with laser beams, according to the image data that was inputted from a computer or the like (not shown). The laser beams form electrostatic latent image on the circumferential surfaces of the photosensitive drums 131. By applying toner from the developing devices 134 to the electrostatic latent images, toner images are formed on the circumferential surfaces of the photosensitive drums 131. Then, these toner images are transferred to the running intermediate transfer belt 21.

The developing devices 134 include stirring/conveying members and have developing rollers at the bottom thereof, whose circumferential surfaces are opposite to the circumferential surfaces of the photosensitive drums 131. The rotation of the developing roller supplies toner to the circumferential surfaces of the photosensitive drums 131.

The fixing section 14 fixes the image that was transferred to the sheet P at the image forming section 13. The fixing section 14 includes a fixing roller 141 that is heated by an electric heater, such as a halogen lamp, and a pressure roller 142 that is opposite to the fixing roller 141. The pressure roller 142 is positioned below the fixing roller 141 and the circumferential surface thereof is pressed against the fixing roller 141.

The sheet P, to which the image is transferred by the intermediate transfer belt 21 in the image forming section 13, is guided by the running intermediate transfer belt 21 and is fed into the fixing section 14, while being held between the intermediate transfer belt 21 and the secondary transfer roller 137. The sheet P is heated as it passes between the fixing roller 141 and the pressure roller 142, whereby the toner image is fixed to the sheet P.

After the fixing process, the sheet P is fed upward through a sheet-output conveying path 101 by a pair of output rollers 143. The sheet P passes through a sheet-output port 152 and is fed to the sheet-output tray 151 provided at the top of the printer body 11.

Figure 2:
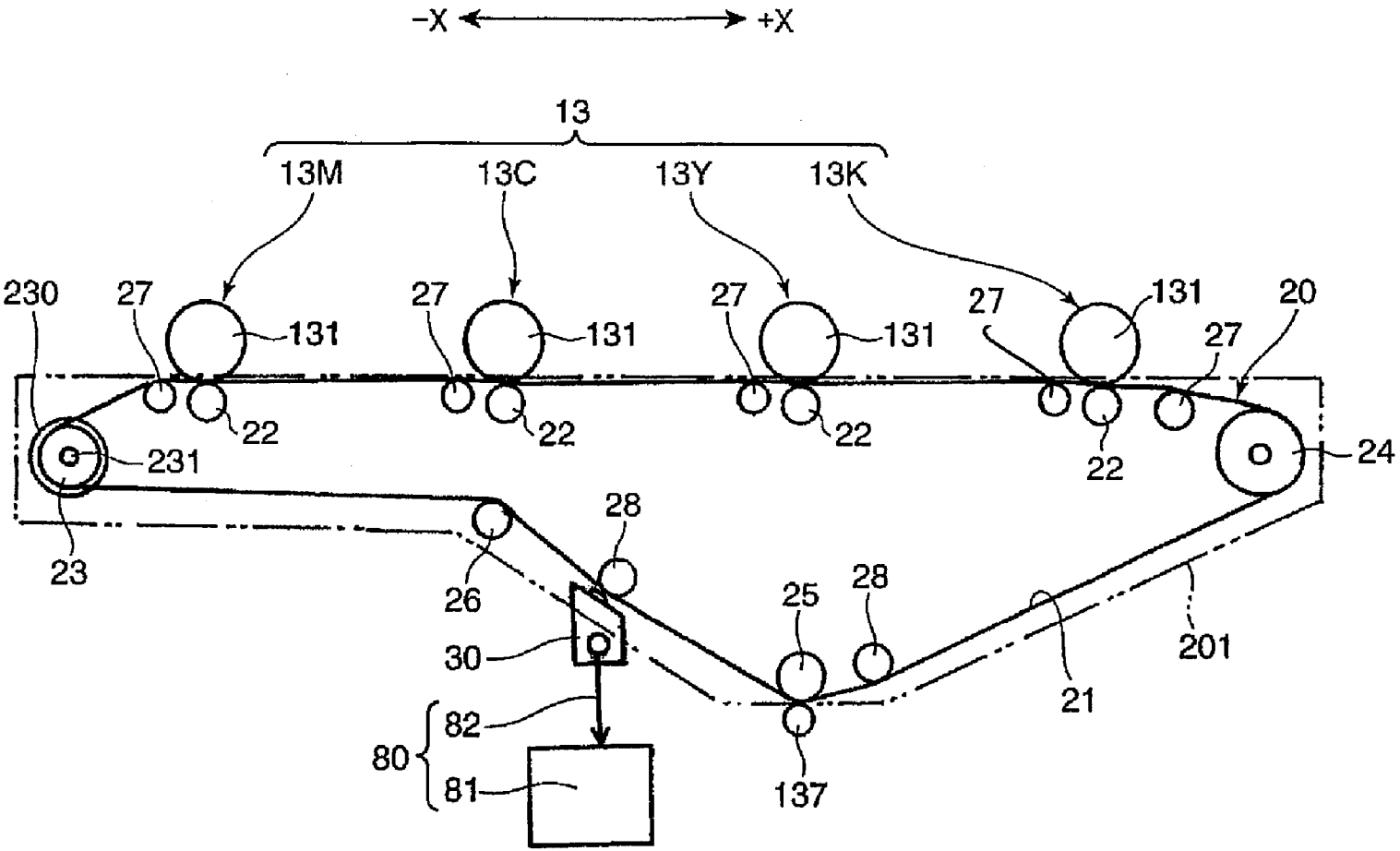
FIG. 2 illustrates an intermediate transfer unit having an intermediate transfer belt of the embodiment of FIG. 1.

FIG. 2 illustrates the intermediate transfer unit 20 including the intermediate transfer belt 21 etc., illustrated in FIG. 1. Similar to FIG. 1, in FIG. 2, the −X direction refers to the left and the +X direction refers to the right. As shown in FIG. 2, the intermediate transfer unit 20 includes the primary transfer rollers 22, the driving roller 23, the following roller 24, the pressing roller 25, a bending roller 26, upper tension rollers 27, lower tension rollers 28, and the intermediate transfer belt 21 looped around the aforementioned rollers.

In the front view, viewed from the direction perpendicular to the plane of the sheet of FIG. 2, the intermediate frame 201 is shaped such that it is elongated in the left-right direction and has an inverted triangular plate extending downwardly from the lower edge on substantially the right half thereof. From a plan view, as illustrated in FIG. 3, the intermediate frame 201 has a rectangular shape that is elongated in the left-right direction.

The primary transfer rollers 22 are positioned at equal intervals in the left-right direction along the upper edge of the intermediate frame 201 corresponding to the photosensitive drums 131 of the units 13M, 13C, 13Y, and 13K.

The driving roller 23 is located at the left end of the intermediate frame 201. The driving roller 23 is driven by a belt-driving motor 230. The belt-driving motor 230 is located behind the driving roller 23 (behind the sheet of FIG. 2), coaxially with the driving roller 23. The driving roller 23 is coaxially connected to a driving shaft 231 of the belt-driving motor 230 so as to be integrally rotatable.

The following roller 24 is located at the right end of the intermediate frame 201. The intermediate transfer belt 21 loops around the driving roller 23 and the following roller 24. The four primary transfer rollers 22 and the five upper tension rollers 27 are positioned along the lower surface of the upper belt of the intermediate transfer belt 21.

The pressing roller 25, that presses the intermediate transfer belt 21 against the secondary transfer roller 137, is located at the lowest position of the inverted triangle provided on the right half of the intermediate frame 201, so as to be oppose to the secondary transfer roller 137 with the intermediate transfer belt 21 being therebetween. Due to the pressing roller 25 pressing the intermediate transfer belt 21 against the secondary transfer roller 137, the toner image on the intermediate transfer belt 21 is transferred to the sheet P conveyed to the position of the pressing roller 25.

The bending roller 26 is located in the intermediate frame 201 substantially immediately below the primary transfer roller 22 of the cyan unit 13C on the right side of the driving roller 23. The bending roller 26 bends the intermediate transfer belt 21 upward at this position.

The secondary transfer roller 137 located immediately below the pressing roller 25 is pressed by the pressing roller 25 with the intermediate transfer belt 21 therebetween. A bias voltage from a power source (not shown) that electrostatically attracts the toner image off the intermediate transfer belt 21 is applied to the secondary transfer roller 137. Thus, the toner image on the intermediate transfer belt 21 is transferred to the sheet P passing between the intermediate transfer belt 21 and the secondary transfer roller 137.

Each upper tension roller 27 is located to the left of the corresponding primary transfer roller 22 and the left of the following roller 24. One of the lower tension rollers 28 is located between the bending roller 26 and the pressing roller 25, and the other lower tension rollers 28 is located between the following roller 24 and the pressing roller 25. The upper and lower tension rollers 27 and 28 serve to maintain the tension of the intermediate transfer belt 21.

In this embodiment, the belt cleaning device 30 is attached below the lower tension roller 28, on the left side, with the intermediate transfer belt 21 therebetween, in the intermediate frame 201 of the thus-configured intermediate transfer unit 20.

Figure 3A:
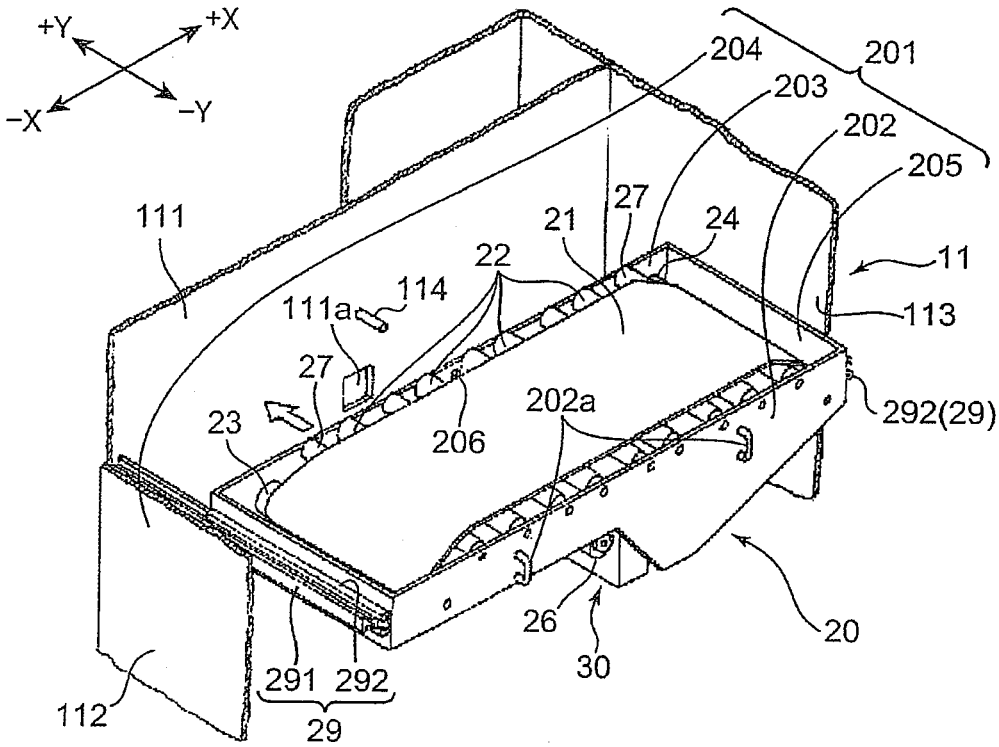
FIGS. 3A and 3B are schematic front perspective views illustrating the relative positional relationship between an intermediate frame and a belt cleaning device.
Figure 3B:
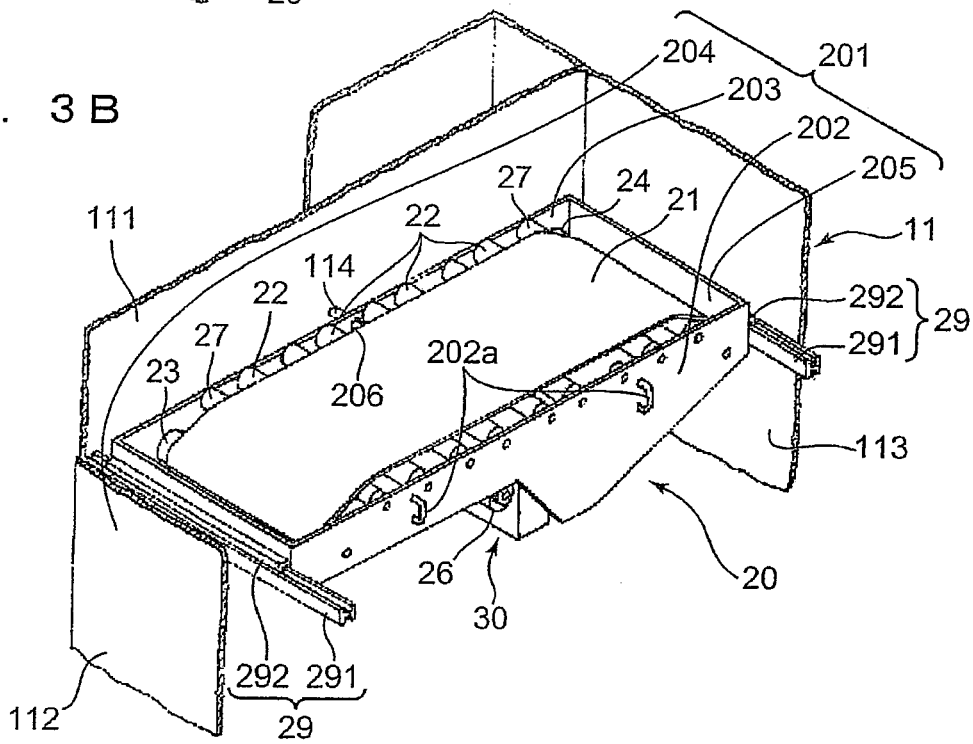
Figure 4A:
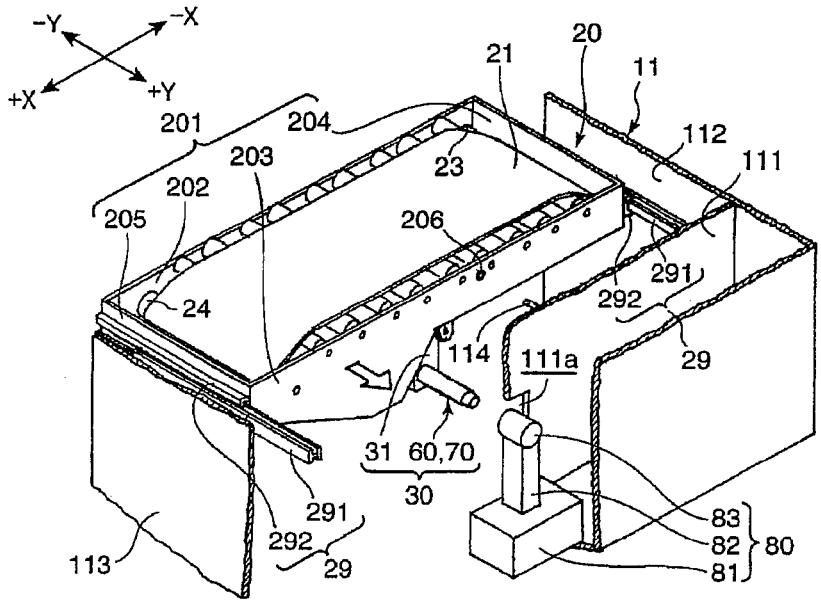
FIGS. 4A and 4B are schematic rear perspective views for illustrating the relative positional relationship between the intermediate frame and the belt cleaning device.
Figure 4B:
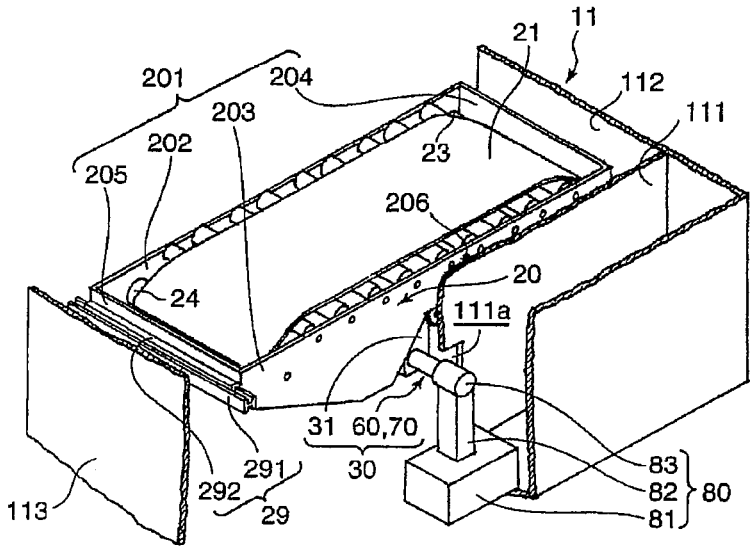

FIGS. 3A, 3B, 4A, and 4B are schematic perspective views illustrating the relative positional relationship between the intermediate frame 201 and the belt cleaning device 30. FIGS. 3A and 3B are front perspective views, and FIGS. 4A and 4B are rear perspective views. Among them, FIGS. 3A and 4A illustrate the state immediately before the waste-toner discharging pipe 60 is connected to the waste-toner collecting pipe 82, and FIGS. 3B and 4B illustrate the state in which the waste-toner discharging pipe 60 is connected to the waste-toner collecting pipe 82. In FIGS. 3A, 3B, 4A, and 4B, the X direction refers to the left-right direction and the Y direction refers to the front-rear direction. More specifically, the −X direction refers to the left, the +X direction refers to the right, the −Y direction refers to the front, and the +Y direction refers to the rear.

As illustrated in FIGS. 3A, 3B, 4A, and 4B, the intermediate frame 201 has a rectangular shape that is elongated in the left-right direction, in plan view. The intermediate frame 201 includes a front frame plate 202 having a shape corresponding to the path along which the intermediate transfer belt 21 runs, in front view, viewed from the −Y direction, a rear frame plate 203 having substantially the same shape as the front frame plate 202 and positioned on the rear side opposite the front frame plate 202. The intermediate frame 201 also includes a left frame plate 204 and a right frame plate 205 extending between the front frame plate 202 and the rear frame plate 203 at the left end and at the right end, respectively.

The primary transfer rollers 22, the driving roller 23, the following roller 24, the pressing roller 25, the bending roller 26, the upper tension rollers 27, and the lower tension rollers 28 are secured between the front frame plate 202 and the rear frame plate 203 so as to be rotatable about predetermined shafts. The intermediate transfer belt 21 is looped around rollers 22 to 28.

The printer body 11 has a rear wall 111 located on the rear side, and a left side wall 112 and a right side wall 113 extending toward the front from the left and right edges of the rear wall 111, respectively. The intermediate transfer unit 20 is positioned between the left side wall 112 and the right side wall 113, so as to be movable in a front-rear direction.

More specifically, rail members 29 are each located between the left frame plate 204 and the left side wall 112, and between the right frame plate 205 and the right side wall 113. The rail members 29 include fixed rails 291 that are secured to the left and right side walls 112 and 113 so as to face each other and extend in a front-rear direction. Movable rails 292 are provided on the left and right frame plates 204 and 205 so as to be slidably supported by the fixed rails 291.

Thus, the intermediate transfer unit 20 can be moved between a stored position and a pulled-out position by gripping grips 202*a* provided at appropriate positions on the front frame plate 202 and moving the intermediate transfer unit 20 in a front-rear direction.

A positioning pin 114, which projects forward, is provided at substantially the center, in a left-right direction, of the rear wall 111. A positioning hole 206 is provided in the rear frame plate 203, of the intermediate transfer unit 20, at a position corresponding to the positioning pin 114—slightly below the upper edge of the intermediate transfer unit 20. Wherein the intermediate transfer unit 20 is inserted into the printer body 11, the positioning pin 114 is received in the positioning hole 206. Thus, the intermediate transfer unit 20 is positioned in the printer body 11.

In the intermediate frame 201 of the thus-configured intermediate transfer unit 20, the belt cleaning device 30 is attached at a position immediately to the left to the pressing roller 25 and immediately below the lower tension roller 28 on the left side, with the intermediate transfer belt 21 therebetween. Thus, the belt cleaning device 30 moves with the intermediate frame 201.

Figure 5:
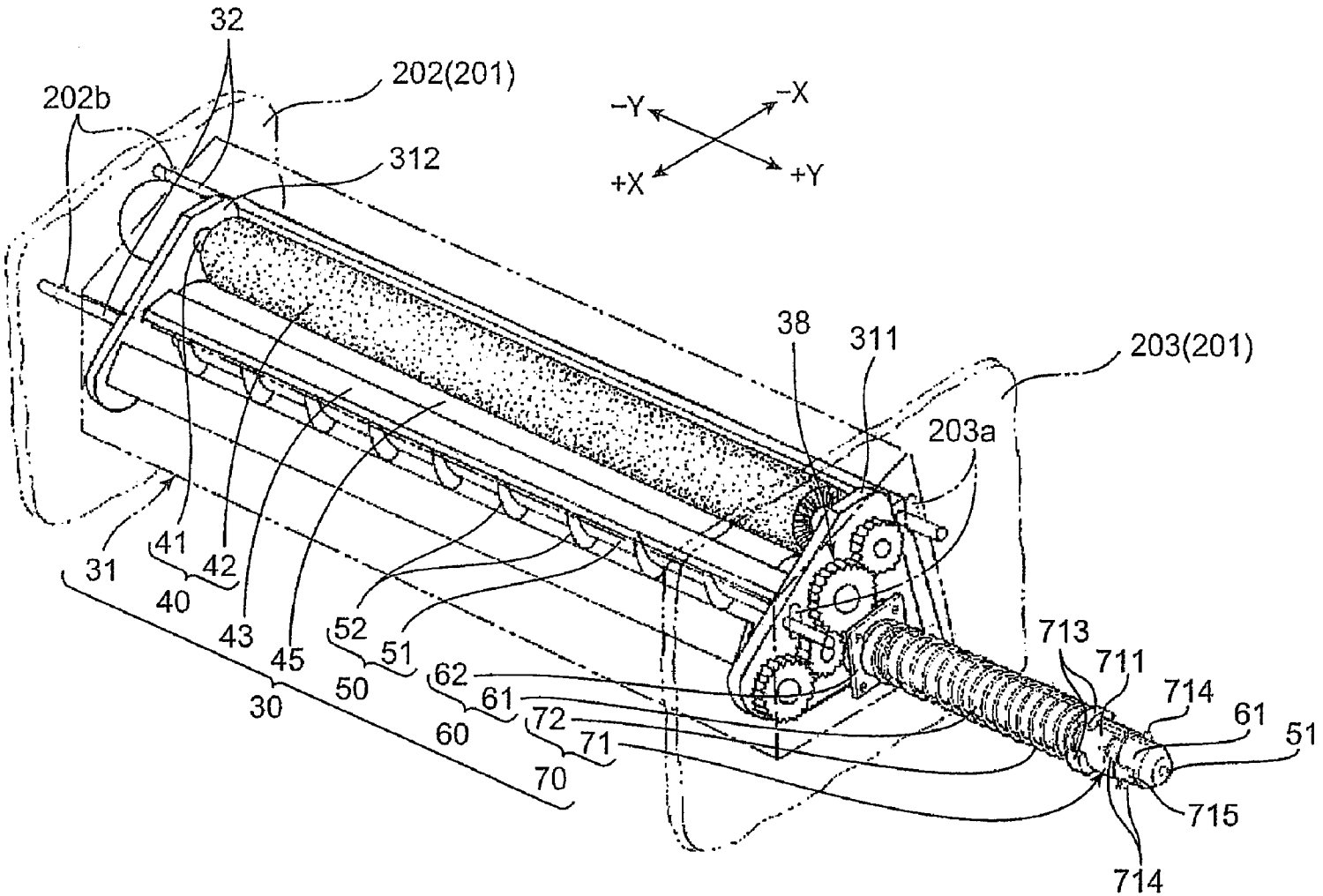
FIG. 5 is a perspective view of the belt cleaning device according to an embodiment of the present invention.

FIG. 5 is a perspective view illustrating the belt cleaning device 30 according to an embodiment. Similar to FIGS. 4A and 4B, in FIG. 5, the −X direction refers to the left, the +X direction refers to the right, the −Y direction refers to the front, and the +Y direction refers to the rear.

As illustrated in FIG. 5, the belt cleaning device 30 includes a box-shaped casing 31, indicated by a two-dot broken line. The box-shaped casing 31 includes a brush roller 40 whose circumferential surface is in contact with the surface of the intermediate transfer belt 21, a charging roller 45 that electrostatically removes the waste toner, scraped off the intermediate transfer belt 21 by the brush roller 40, by suction, and a blade 43 that scrapes off the waste toner deposited on the circumferential surface of the charging roller 45. The casing 31 also includes a screw member (conveying screw) 50 that feeds the waste toner scraped off by the blade 43 toward the waste-toner collecting pipe 82 (described below), the waste-toner discharging pipe 60 that extends through the rear plate 311 projecting toward the waste-toner collecting pipe 82 on the rear side, and a shutter structure 70 fitted to the outer circumference of the waste-toner discharging pipe 60.

The waste-toner discharging pipe 60 and a portion of the screw member 50 located in the waste-toner discharging pipe 60 form an embodiment of the toner conveying device 1 of the present invention. The toner conveying device 1 will be described below.

The brush roller 40 includes a brush shaft 41 positioned between the rear plate 311 and a front plate 312 of the casing 31, at an upper position. Bristles 42 are attached to the brush shaft 41 in a column shape coaxially with the brush shaft 41. A brush-driving motor 39 with a driving shaft extends in a front-rear direction and is secured to the front side of the front plate 312. The driving shaft of the brush-driving motor 39 is coaxially connected to the brush shaft 41 so as to be rotatable together with the brush shaft 41. Thus, the driving rotation of the brush-driving motor 39 is directly transmitted to the brush roller 40.

The waste toner, that is scraped off from the intermediate transfer belt 21 by the rotation of the brush roller 40 and deposited on the circumferential surface of the charging roller 45, is removed by the blade 43 and falls on the screw member 50 located therebetween.

The screw member 50 includes a screw shaft 51 extending between the rear plate 311 and the front plate 312 in the casing 31, at a lower position, and a spiral fin 52 that is coaxially formed around the screw shaft 51. The screw member 50 extends through the inside of the waste-toner discharging pipe 60. Therefore, rotation of the spiral fin 52, about the screw shaft 51, forces the waste toner that has accumulated on the bottom of the casing 31 toward the toner collection unit 80 through the waste-toner discharging pipe 60.

A gear mechanism 38 for transmitting the driving force of the brush-driving motor 39 to the screw member 50 is located in the casing 31, on the rear plate 311 side. Thus, the driving rotation of the brush-driving motor 39 is transmitted to the screw member 50 via the brush shaft 41 and the gear mechanism 38.

In this belt cleaning device 30, a predetermined number of column-shaped front engaging projections 32 are provided on the front plate 312 of the casing 31 so as to project forward, and a predetermined number of column-shaped rear engaging projections 33 are provided on the rear plate 311 of the casing 31.

The front frame plate 202 of the intermediate frame 201 (FIGS. 4A and 4B) includes engaging holes 202*b* at positions that correspond to the front engaging projections 32. The front engaging projections 32 are slidably inserted into the engaging holes 202*b*. The rear frame plate 203 has elongated holes 203*a* extending in a top-bottom direction, at positions that correspond to the rear engaging projections 33, into which the rear engaging projections 33 are inserted. By inserting the front engaging projections 32 into the engaging holes 202*b*, and the rear engaging projections 33 into the elongated holes 203*a*, the belt cleaning device 30 is coupled to the intermediate frame 201.

The elongated holes 203*a* that receive the rear engaging projections 33 are elongated so that there is clearance to compensate for any dimensional error or assembly error when the waste-toner discharging pipe 60 is connected to the waste-toner collecting pipe 82 (described below). To provide this compensation, the waste-toner discharging pipe 60 can move vertically.

When the intermediate transfer unit 20 is in a pulled-out state and then pushed into the printer body 11, the tip of the waste-toner discharging pipe 60 is connected to the toner collection unit 80 located behind the rear wall 111 of the printer body 11. Thus, the waste toner scraped off from the intermediate transfer belt 21 by the belt cleaning device 30 is collected by the toner collection unit 80.

Figure 9A:
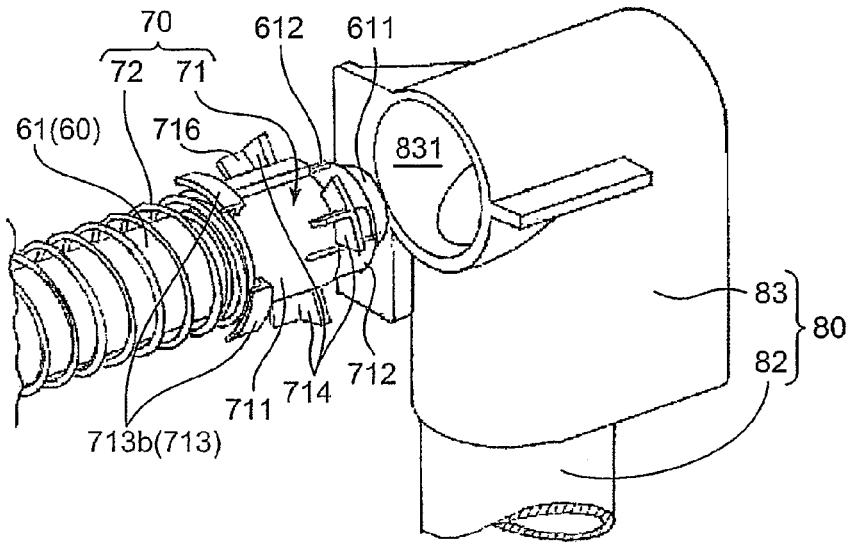
FIGS. 9A and 9B are perspective views illustrating a connecting operation for connecting the belt cleaning device to a toner collection unit.
Figure 9B:
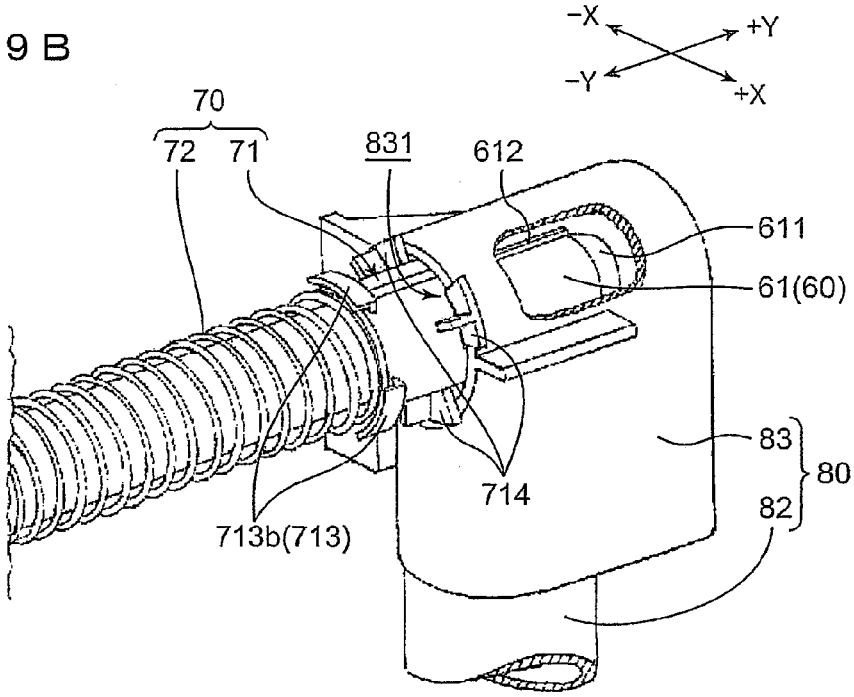

As illustrated in FIGS. 4A and 4B, the toner collection unit 80 includes a waste toner reservoir 81 located on the bottom plate on the rear side of the printer body 11. The waste-toner collecting pipe 82 extends upright from the top plate of the waste toner reservoir 81. As illustrated in FIGS. 9A and 9B, a waste-toner receiving member 83 having a connection opening (waste toner receiving port) 831 that opens forward, to which a pipe body 61 (described below) is connected, is positioned on the waste-toner collecting pipe 82.

Figure 6:
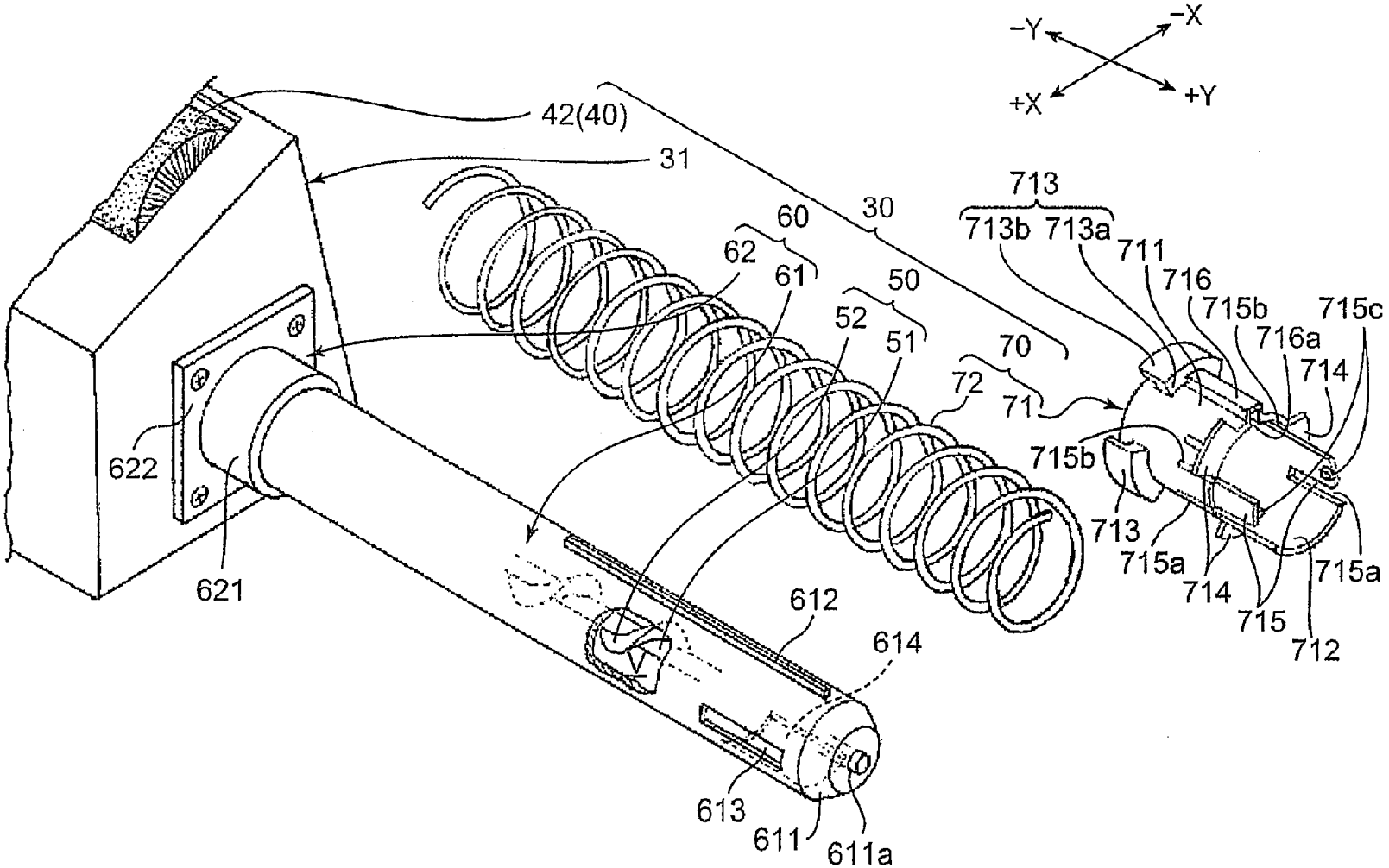
FIG. 6 is a partial exploded perspective view of FIG. 5, illustrating the waste-toner discharging pipe and a shutter mechanism according to an embodiment of the present invention.
Figure 7:
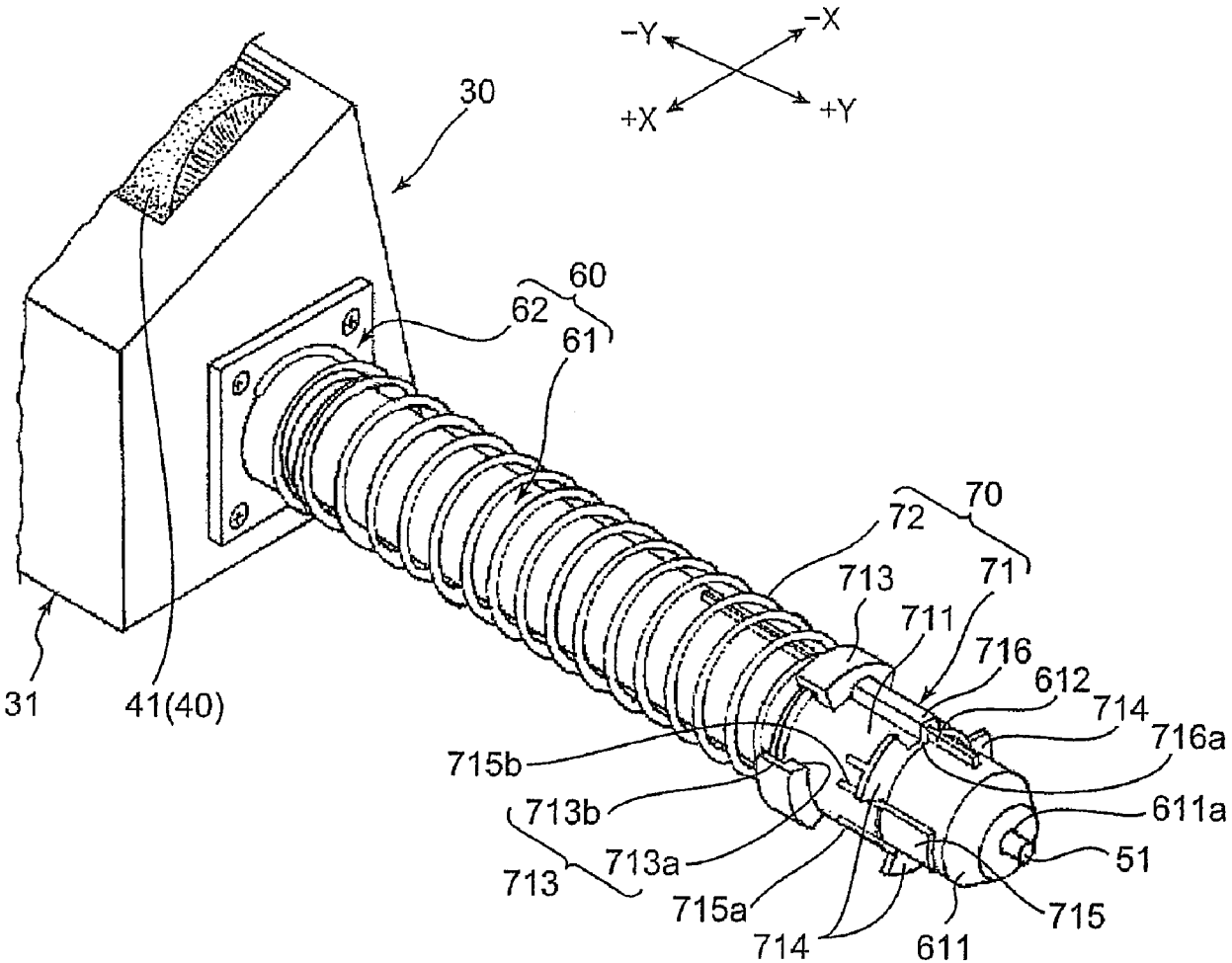
FIG. 7 is a partial perspective view of FIG. 5, illustrating, in an assembled state, a waste-toner discharging pipe and a shutter mechanism according to an embodiment of the present invention.

FIGS. 6 and 7 are partial views of FIG. 5 illustrating the waste-toner discharging pipe 60 and the shutter structure 70 according to an embodiment. FIG. 6 is a partial exploded perspective view of FIG. 5, and FIG. 7 is a perspective view of the same in an assembled state. Similarly to FIG. 3, in FIGS. 6 and 7, the −X direction refers to the left, the +X direction refers to the right, the −Y direction refers to the front, and the +Y direction refers to the rear.

As illustrated in FIG. 6, the waste-toner discharging pipe 60 includes a pipe body (conveying pipe) 61 and a fixing base 62 for securing the pipe body 61 to the rear plate 311 of the casing 31. The pipe body 61 has a conical portion 611 has a tapered shape that is coaxial with the pipe body 61 at a tip portion (rear end) thereof. The inclined circular surface of this tapered conical portion 611 allows the pipe body 61 to be easily coupled to the connection opening 831 in the waste-toner receiving member 83. The conical portion 611 has, at the position of the shaft center, a center hole 611*a* that receive the tip of the screw shaft 51 to support the screw shaft 51.

The pipe body 61 has a guide rail 612 extending in a front-rear direction on the top of the circumferential surface. This guide rail 612 serves to maintain a predetermined phase, when a shutter tube 71 of the shutter structure 70, coupled to the outer circumference of the pipe body 61, is moved in a front-rear direction.

The pipe body 61 has, on both the left and right sides thereof, a pair of slide-guide grooves 613 that are recessed toward each other and extend in a front-rear direction. These slide-guide grooves 613 determine the range in which the shutter structure 70, coupled to the outer circumference of the pipe body 61, can move.

The fixing base 62 includes a pipe holding tube 621 that is coaxial with the base end portion (front end) of the pipe body 61 and has a larger diameter than the pipe body 61, and a rectangular flange 622 secured to the base end of the pipe holding tube 621 so as to be coupled to the outer circumference thereof. The waste-toner discharging pipe 60 is secured to the rear plate 311 of the casing 31 via the flange 622 which is screwed at four corners.

A waste-toner conveying path V for feeding waste toner toward the toner collection unit 80 by the rotation of the screw member 50, about the axis, is formed in the pipe body 61 of the waste-toner discharging pipe 60.

As illustrated in FIG. 6, the shutter structure 70 includes the shutter tube 71 coupled to the outer circumference of the pipe body 61, so as to be in slidable contact therewith, and a coil spring 72 that urges the shutter tube 71, that is coupled to the outer circumference of the pipe body 61, toward the tip side.

Figure 8A:
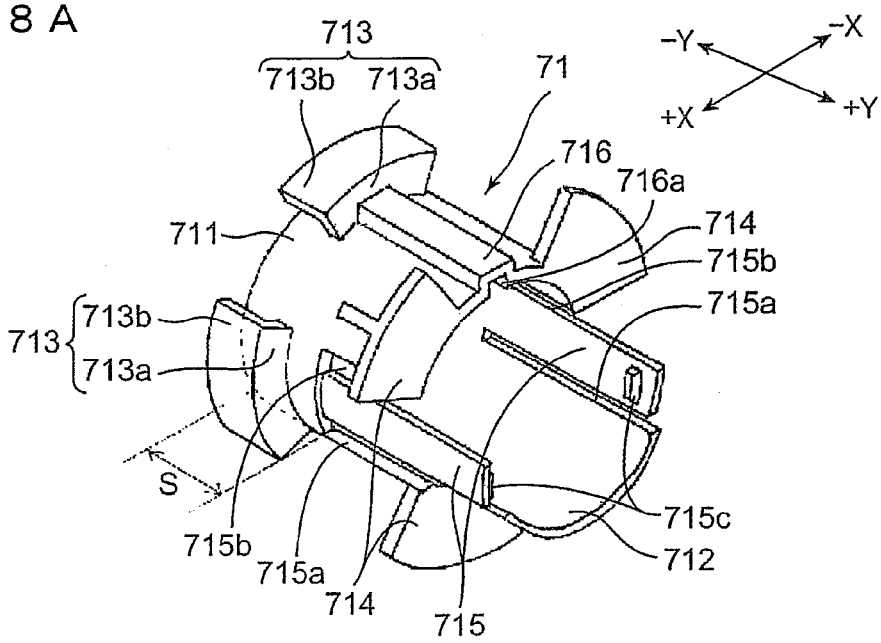
FIGS. 8A and 8B are enlarged perspective views of a shutter tube according to an embodiment of the present invention, FIG. 8A illustrating the shutter tube viewed from the rear right, and FIG. 8B illustrating the shutter tube viewed from the front right.
Figure 8B:
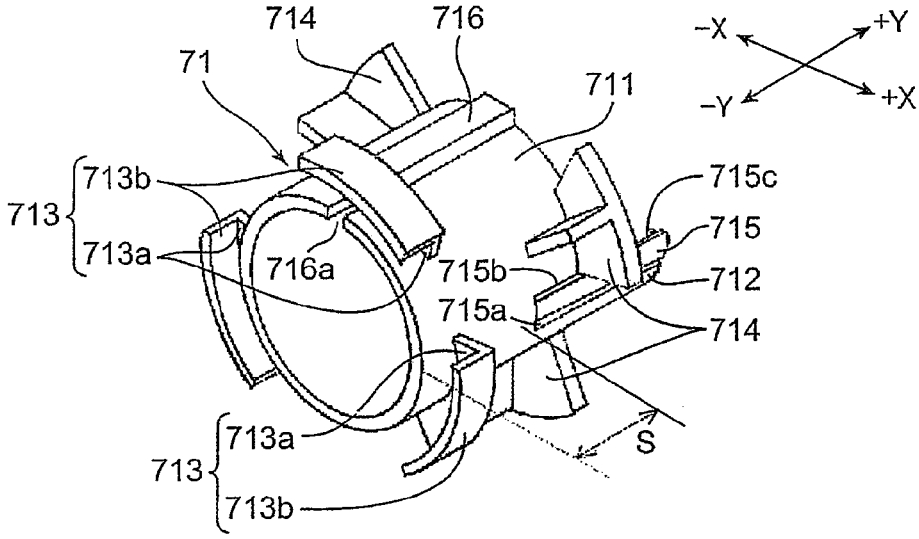

The shutter structure 70, in particular, the shutter tube 71, will be described below with reference to FIGS. 8A and 8B (and the other drawings). FIGS. 8A and 8B are enlarged perspective views of the shutter tube 71 according to an embodiment, viewed from the rear right and from the front right, respectively. Similarly to FIG. 3, in FIG. 8, the −X direction refers to the left, the +X direction refers to the right, the −Y direction refers to the front, and the +Y direction refers to the rear.

As illustrated in FIGS. 8A and 8B, the shutter tube 71 includes a tube body 711 having an inside diameter that is slightly larger than the outside diameter of the pipe body 61, and an arcuate shutter plate 712 projecting rearwardly from substantially the lower half part of the rear edge of the tube body 711. A plurality of spring-receiving projections 713 are located at equal intervals in the circumferential direction and project radially outwardly from the front edge of the tube body 711. A plurality of stopper projections 714 are located at equal intervals in the circumferential direction and project radially outwardly from the rear edge of the tube body 711. A pair of snap-fit members 715, that function as elastic arms, extend in a front-rear direction and are formed at the rear edge of the tube body 711, immediately above the left and right edges of the arcuate shutter plate 712. A reinforcing rib 716 extends in a front-rear direction and projects radially outwardly from the top surface of the tube body 711.

While the curvature of the inside diameter of the arcuate shutter plate 712 is the same as the inside diameter of the tube body 711, the curvature of the outside diameter of the arcuate shutter plate 712 is slightly smaller than the outside diameter of the tube body 711. This provides a margin on the shutter tube 71 for the sealing member (not shown) that is attached to the periphery of a waste toner discharge port 614 of the pipe body 61. This structure enables the arcuate shutter plate 712 to be smoothly moved between an open position and a closed position while sliding on the sealing member.

In this embodiment, three spring-receiving projections 713 are located at equal intervals in the circumferential direction. Each spring-receiving projection 713 is shaped such that the edges, in the circumferential direction, extend along lines extending in the radial direction (diameter lines). The central angle formed between a pair of diameter lines is 60°. Thus, the length of the arc, in the circumferential direction, of the spring-receiving projections 713 on the circumferential surface of the tube body 711 equals the spaces between the adjacent spring-receiving projections 713.

The spring-receiving projections 713 each include a fan-shaped projection 713*a*, having a fan shape in front view and a roof-shaped projection 713*b* having an arcuate shape in front view, that project forward from the radially outer edge of the fan-shaped projection 713*a*. The rear end of the coil spring 72, coupled to the outer circumference of the pipe body 61, is fitted to the gaps between the outer circumferential surface of the tube body 711 and the roof-shaped projections 713*b*.

In this embodiment, one of the three spring-receiving projections 713 is positioned opposite the arcuate shutter plate 712 on the circumferential surface of the tube body 711.

Similar to the above-described spring-receiving projections 713, three stopper projections 714 are positioned at equal intervals in the circumferential direction. The stopper projections 714 are provided at locations that correspond to the spaces between the adjacent spring-receiving projections 713 in the front-rear direction. Similar to the above-described spring-receiving projections 713, the central angles of these stopper projections 714 are 60°. This allows easy removal of the shutter tube 71 from the mold in which the shutter tube 71 is made; the shutter tube is made of a thermoplastic synthetic resin by injection molding.

The curvature of the outside diameter of these stopper projections 714 is larger than the inside diameter of the connection opening 831 in the waste-toner receiving member 83. Therefore, when the tip (rear end) of the pipe body 61 is inserted into the connection opening 831 in the waste-toner receiving member 83, the pipe body 61 can enter the connection opening 831, but the shutter tube 71 cannot due to the stopper projections 714.

Accordingly, when the pipe body 61 is inserted into the connection opening 831, the arcuate shutter plate 712 moves forward, thereby opening the waste toner discharge port 614 of the pipe body 61 which had been closed by the arcuate shutter plate 712.

The pair of snap-fit members 715 are located immediately above the arcuate shutter plate 712, at positions that are point-symmetrical to each other in the left-right direction with respect to the axis of the shutter tube 71. These snap-fit members 715 extend rearwardly from the rear edge of the tube body 711 by the same distance which the arcuate shutter plate 712 extends. First slits 715*a*, extending in a front-rear direction, are formed between the arcuate shutter plate 712 and the snap-fit members 715. Second slits 715*b*, extending forward, are formed at portions corresponding to the upper edges of the snap-fit members 715 of the tube body 711.

The front ends of the first and second slits 715*a* and 715*b* are at the same position. The first and second slits 715*a* and 715*b* substantially increases the length of the snap-fit members 715, allowing for radial elastic deformation.

The snap-fit members 715 each have a guided projection 715*c* projecting toward the other snap-fit member 715 at the tip (rear end) on the surface facing the other snap-fit member 715. The guided projections 715*c* are shaped so that they can be fitted to the slide-guide grooves 613 provided in the pipe body 61. This structure prevents the tube body 711 from slipping off from the pipe body 61 and can move in a front-rear direction a distance in which the guided projections 715*c* that allows the tube body 711 to move in a front-rear direction in the slide-guide grooves 613.

The spring-receiving projections 713 are located at arbitrary positions between the front edge of the tube body 711 and the front ends of the first and second slits 715*a* and 715*b* (hereinafter referred to as a "projection placeable area S"). By providing the spring-receiving projections 713 at arbitrary positions in the projection placeable area S, the force of the coil spring 72 can be set to a desired value. That is, the spring-receiving projections 713 can be provided at positions where a preset force of the coil spring 72 can be obtained. This increases design flexibility.

In this embodiment, the reinforcing rib 716 is located at a position that is point-symmetrical to the arcuate shutter plate 712 with respect to the axis of the tube body 711 (that is, at the top of the tube body 711). A guided groove 716*a* is provided in the inner circumferential surface of the tube body 711 and extends in a front-rear direction over the entire length of the tube body 711 at a position corresponding to the reinforcing rib 716. The guided groove 716*a* is dimensioned such that it slidably fits the outer circumference of the guide rail 612 that projects from the pipe body 61. Accordingly, by fitting the shutter tube 71 to the pipe body 61 with the guided groove 716*a* being fitted to the outer circumference of the guide rail 612, the shutter tube 71 can move in a front-rear direction along the pipe body 61 without rotating.

The coil spring 72 urges the shutter tube 71, that is coupled to the outer circumference of the pipe body 61 toward the tip (rearward). The length of the coil spring 72 is set so that it extends at least between the front end surfaces of the fan-shaped projections 713*a* of the spring-receiving projections 713 and the rear surface of the flange 622 of the waste-toner discharging pipe 60, when the shutter tube 71 is located at the front most side.

The inside diameter of the coil spring 72 is slightly larger than the outside diameters of the pipe holding tube 621 and shutter tube 71. The outside diameter of the coil spring 72 is slightly smaller than the curvature of the inside diameter of the roof-shaped projection 713*b* of the spring-receiving projections 713. Thus, by coupling the shutter tube 71 to the outer circumference of the pipe body 61 with the coil spring 72 being coupled to the outer circumference of the pipe body 61 and by coupling the guided projections 715*c* to the slide-guide grooves 613 in the pipe body 61, the coil spring 72 is coupled to the waste-toner discharging pipe 60, as illustrated in FIG. 7, and can urge the shutter tube 71 rearwardly.

Figure 10A:
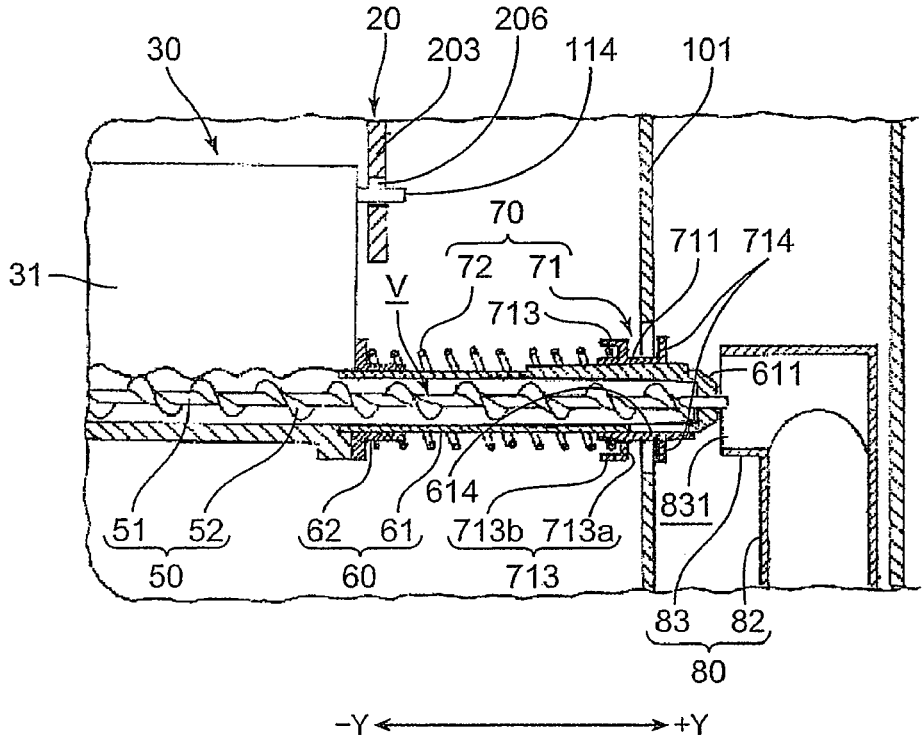
FIGS. 10A and 10B are side sectional views illustrating the connection operation for connecting the belt cleaning device to the toner collection unit.
Figure 10B:
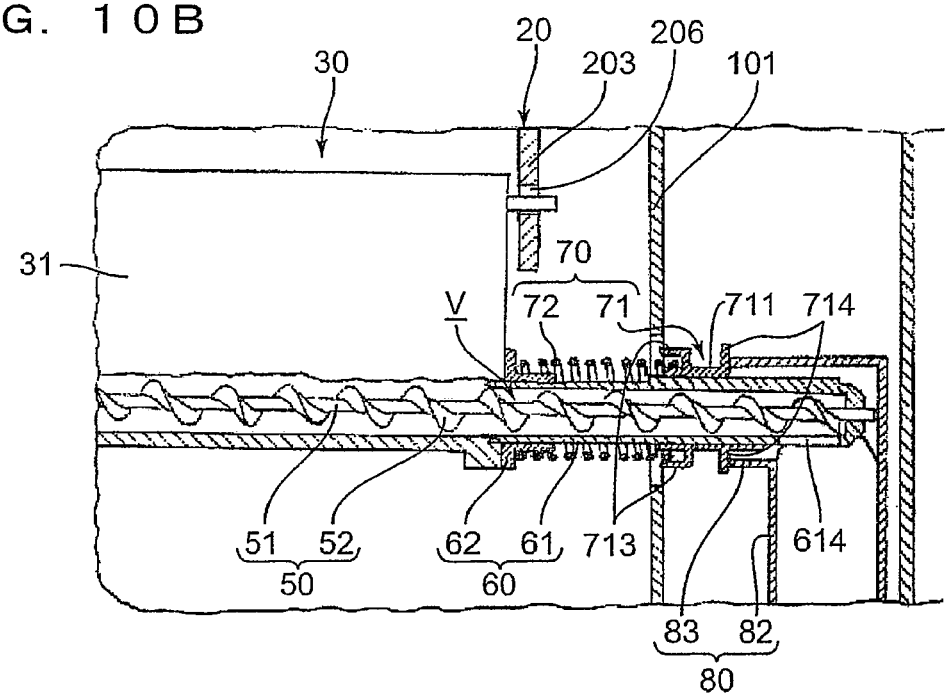

FIGS. 9A, 9B, 10A, and 10B are diagrams illustrating an operation to connect the belt cleaning device 30 to the toner collection unit 80. FIGS. 9A and 9B are perspective views, and FIGS. 10A and 10B are side sectional views corresponding to FIGS. 9A and 9B. In these diagrams, FIGS. 9A and 10A illustrate the state immediately before the waste-toner discharging pipe 60 of the belt cleaning device 30 is connected to the waste-toner receiving member 83 of the toner collection unit 80, and FIGS. 9B and 10B illustrate the state in which the waste-toner discharging pipe 60 of the belt cleaning device 30 is connected to the waste-toner receiving member 83 of the toner collection unit 80. Similarly to FIG. 5, in FIGS. 9A, 9B, 10A, and 10B, the −X direction refers to the left, the +X direction refers to the right, the −Y direction refers to the front, and the +Y direction refers to the rear.

The connection of the belt cleaning device 30 to the toner collection unit 80 will be described below with reference to FIGS. 9A, 9B, 10A, and 10B (and other drawings if necessary). First, when the intermediate transfer unit 20 is inserted into the printer body 11, as illustrated by open arrows in FIGS. 3A and 4A, the belt cleaning device 30 supported by the intermediate frame 201 of the intermediate transfer unit 20 approaches the toner collection unit 80. As a result, the waste-toner discharging pipe 60 extends through a through-window 111*a* located in the rear wall 111 of the printer body 11, and the tip of the pipe body 61 of the waste-toner discharging pipe 60 faces the connection opening 831 in the waste-toner receiving member 83 of the toner collection unit 80, as illustrated in FIGS. 9A and 10A.

At this time, the belt cleaning device 30 is slightly inclined rearwardly due to the weight of the waste-toner discharging pipe 60 projecting rearwardly. Thus, the axis of the waste-toner discharging pipe 60 is not always aligned with the center line of the waste-toner receiving member 83 extending in a front-rear direction, and may be misaligned. However, because the diameter of the connection opening 831 is considerably larger than that of the pipe body 61, and the tapered conical portion 611 is provided at the tip of the pipe body 61, the tip of the pipe body 61 can pass through the connection opening 831 and enter the waste-toner receiving member 83.

When the waste-toner discharging pipe 60 is inserted into the waste-toner receiving member 83 by a predetermined length, the stopper projections 714 of the shutter tube 71 interfere with the peripheral portion of the connection opening 831. When, in this state, the intermediate transfer unit 20 is inserted further into the printer body 11, the shutter tube 71 is urged relatively forward, opening the waste toner discharge port 614 of the pipe body 61 while the waste-toner discharging pipe 60, resists the urging force of the coil spring 72, and therefore is compressed relatively forward.

Accordingly, as illustrated in FIG. 4B, when the intermediate transfer unit 20 is inserted until it stops into the printer body 11 and is in a stored position, the tip of the waste-toner discharging pipe 60 is inserted into the waste-toner receiving member 83, as illustrated in FIGS. 9B and 10B. As a result, the shutter tube 71 moves relatively forward, opening the waste toner discharge port 614 in the waste-toner receiving member 83.

In this state, when the screw member 50 rotates about the screw shaft 51, waste toner in the casing 31 of the belt cleaning device 30 is fed through the pipe body 61 toward the waste-toner receiving member 83. The waste toner then passes through the waste toner discharge port 614, the waste-toner receiving member 83, and the waste-toner collecting pipe 82, and is collected by the waste toner reservoir 81.

Figures 11A, 11B, 11C:
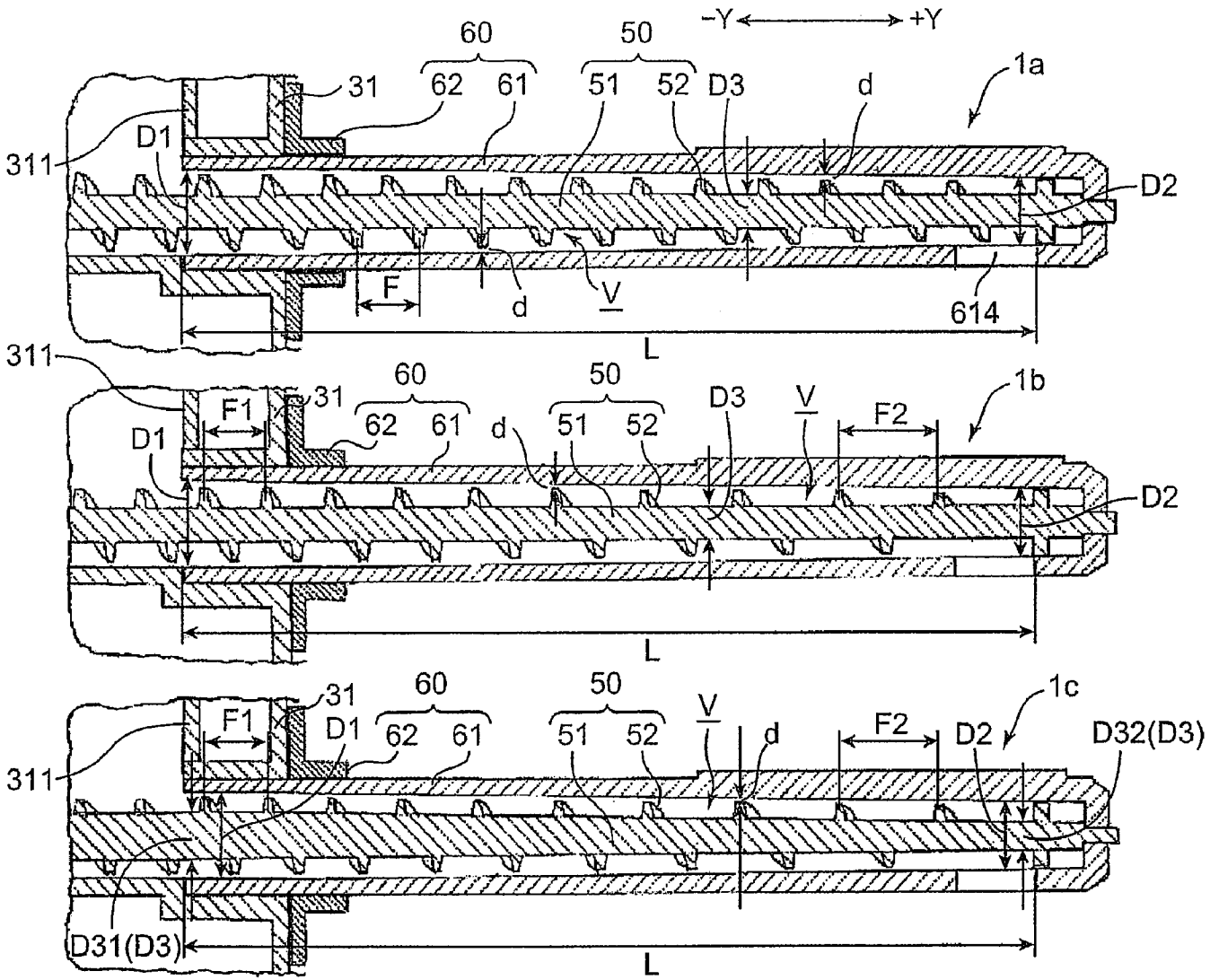
FIGS. 11A to 11C are side sectional views of toner conveying devices according to various embodiments of the present invention.

In this embodiment, the toner conveying device 1 of the present invention is applied to the pipe body 61 of the waste-toner discharging pipe 60. The toner conveying device 1 will be described below with reference to FIG. 11 (and other drawings). FIGS. 11A to 11C are side sectional views of the toner conveying device 1 according to various embodiments, applied to the waste-toner discharging pipe 60, FIG. 11A illustrating a toner conveying device 1*a* according to an embodiment, FIG. 11B illustrating a toner conveying device 1*b* according to another embodiment, and FIG. 11C illustrating a toner conveying device 1*c* according to a still further embodiment. Similarly to FIG. 5, in FIGS. 11A to 11C, the −Y direction refers to the front and the +Y direction refers to the rear.

The toner conveying devices 1*a*, 1*b*, and 1*c* according to the embodiments have the same basic configuration, that is, they comprise the waste-toner discharging pipe 60 and the screw member 50.

As described above, the screw member 50 includes the screw shaft 51 and the spiral fin 52 that is coaxially and spirally formed around the screw shaft 51. As described above, the waste-toner discharging pipe 60 includes the pipe body 61. The pipe body 61 has, inside thereof, the waste-toner conveying path V for feeding toner, and the screw member 50 is coaxially located therein.

In addition, the inside diameter of the pipe body 61 is changed in the pipe-axis direction. In the toner conveying devices 1*a*, 1*b*, and 1*c* according to the embodiments, the inside diameter of the pipe body 61 gradually decreases from the base end side (front end side) toward the tip side (rear end side).

In the toner conveying devices 1*a*, 1*b*, and 1*c* according to the embodiments, the distance between the outer circumferential surface of the spiral fin 52 and the inner circumferential surface of the pipe body 61 (gap distance d) is constant.

This structure allows toner to uniformly deposit on the bottom of the toner conveying path V formed in the pipe body 61 in a longitudinal direction. Thus, the problem of a large amount of toner being locally deposited can be effectively prevented.

Also, the problem of a large amount of toner being locally deposited and released and fed in a non-uniform manner, thereby clogging the toner conveying path V, can be effectively prevented.

Furthermore, in the toner conveying devices 1*a*, 1*b*, and 1*c* according to the embodiments, the inside diameter of the pipe body 61 gradually and linearly decreases from one end (the base end portion) toward the other end (the tip portion). Therefore, for example, when the pipe body 61 is made by injection molding, the pipe body can be easily removed due to the gap formed between the core and the outer mold from the large diameter side. This is advantageous in that it allows the pipe body 61 to be easily produced.

The pipe body 61 of the toner conveying devices 1*a*, 1*b*, and 1*c* according to the embodiments has an effective length L of 170 mm, an inside diameter (diameter) D1 at the base end portion of 12 mm, and an inside diameter (diameter) D2 at the tip portion of 10 mm. In the toner conveying devices 1*a*, 1*b*, and 1*c*, the gap distance d between the inner circumferential surface of the pipe body 61 and the outer circumferential surface of the spiral fin 52 is 0.6 mm.

The toner conveying device 1*a* according to an embodiment, shown in FIG. 11A, is a basic configuration of the toner conveying device 1. The pipe body 61, has an inside diameter that decreases toward the tip, and the spiral fin 52 has an outside diameter that decreases toward the tip, as described above. The spiral pitch F of the spiral fin 52 is constant (in this embodiment, 10 mm) in the longitudinal direction. The diameter of the screw shaft 51 (shaft diameter D3) is constant (in this embodiment, substantially 5 mm) in the longitudinal direction.

With the toner conveying device 1*a* according to this embodiment, because the outside diameter of the spiral fin 52 gradually decreases toward the tip while the shaft diameter D3 of the screw shaft 51 is constant, the conveyance capacity of the spiral fin 52 gradually decreases as the toner moves toward the downstream side (rear side) along the toner conveying path V.

Thus, the toner is compressed as it moves toward the downstream side and the powder density thereof increases. However, this does not present an issue as the pipe body 61 has a waste toner discharge port 614 at the downstream end, through which the toner having a high powder density, due to the compression, is discharged at a high rate to the waste-toner receiving member 83 of the toner collection unit 80.

The toner conveying device 1*b* according to an embodiment, shown in FIG. 11B, is configured such that the spiral pitch F of the spiral fin 52 is substantially inversely proportional to the inside diameter of the pipe body 61 (that is, the spiral pitch F increases as the inside diameter of the pipe body 61 decreases). Thus, the spiral pitch F gradually increases toward the downstream side. In this embodiment, the spiral pitch F of the spiral fin 52 at the upstream-most position (upstream-most spiral pitch F1) is 10 mm, and at the downstream-most position (downstream-most spiral pitch F2) is 15.9 mm.

In the configuration of the toner conveying device 1*b* according to this embodiment, where the pipe body 61 has a large inside diameter, although the speed at which the rotation of the spiral fin 52 feeds toner is lower than that where it has a smaller inside diameter, the amount of toner feed by the spiral fin 52 per unit rotation angle is greater. In contrast, where the pipe body 61 has a smaller inside diameter, although the speed at which the rotation of the spiral fin 52 feeds toner is greater than that at the portion having a larger inside diameter, the amount of toner feed by the spiral fin 52 per unit rotation angle is smaller.

That is, by making the spiral pitch F of the spiral fin 52 substantially inversely proportional to the inside diameter of the pipe body 61, increase/decrease of the feeding speed of the spiral fin 52 and increase/decrease of the amount of toner feed per unit rotation angle compensate for each other. As a result, the amount of toner feed by the pipe body 61 can be easily made uniform in the longitudinal direction of the pipe body 61.

The toner conveying device 1*c* according to another embodiment, illustrated in FIG. 11C, is configured such that the shaft diameter D3 of the screw shaft increases or decreases with an increase or decrease in the inside diameter of the pipe body 61. In this embodiment, the shaft diameter D3 of the screw shaft 51, in the pipe body 61, on the upstream-most side (upstream-most side shaft diameter D31) is 5 mm, and that on the downstream-most side (downstream-most side shaft diameter D32) is 4 mm. The upstream-most spiral pitch F1 is 10 mm, and the downstream-most spiral pitch F2 is set to 14.2 mm. The other configurations are the same as those of the toner conveying device 1*b* according to the previous embodiment.

With the toner conveying device 1*c* having the above-described configuration, because variations in the amount of toner feed by the spiral fin 52 per unit rotation angle of the screw shaft 51 in the longitudinal direction of the pipe body 61 can be more precisely reduced, a more uniform feed of waste toner in the toner conveying path V can be achieved.

As the diameter of the screw shaft 51 decreases, the pitch of the spiral fin 52 also naturally decreases. Although too great a pitch makes the spiral fin 52 more likely to become flat due to elastic deformation or plastic deformation, there is an advantage in that a smaller pitch makes the spiral fin 52 less likely to lay flat.

The present invention is not limited to the above-described embodiments.

Although the image forming apparatus has been described with respect to printer 10 as an example in the above-described embodiments, the image forming apparatus is not limited to a printer 10, and may, for example, be a copier, a facsimile machine, etc.

Although the shutter tube 71 includes three spring-receiving projections 713 and three stopper projections 714 in the above-described embodiments, the number of the spring-receiving projections 713 and stopper projections 714 is not limited to three, but may be two or more than three.

The specific values, mentioned in the above-described embodiments, of the inside diameters D1 and D2 of the base end portion and the tip portion, respectively, of the pipe body 61, the shaft diameter D3 of the screw shaft 51 including the upstream-most side shaft diameter D31 and downstream-most side shaft diameter D32, the gap distance d between the outer circumferential surface of the screw shaft 51 and the inner circumferential surface of the pipe body 61, and the upstream-most spiral pitch F1 and downstream-most spiral pitch F2 of the pipe body 61 are exemplary. Other values can be employed based on calculated results or test results according to equipment specifications and the properties of the toner.

Figure 12:
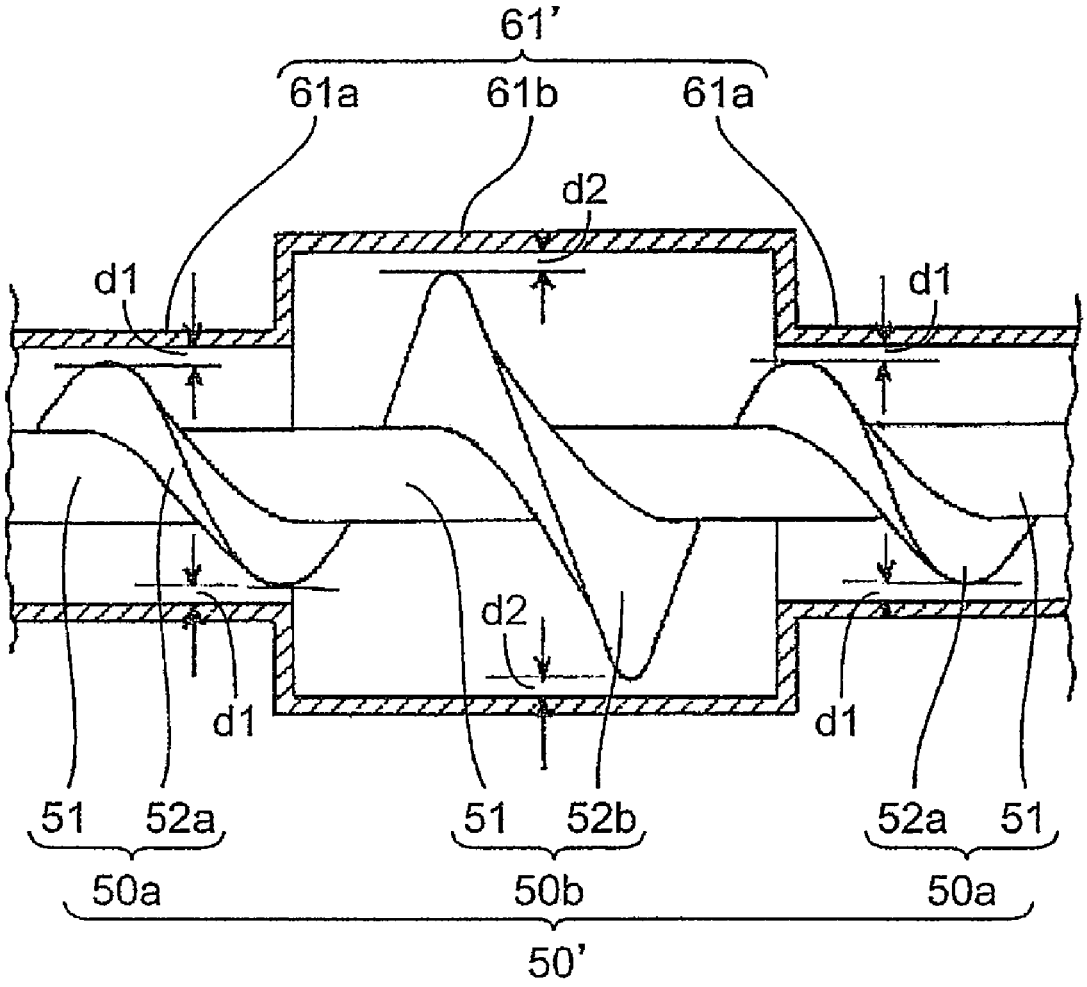
FIG. 12 is a partial enlarged side sectional view of a toner conveying device according to a further embodiment of the present invention.

FIG. 12 is a partial enlarged side sectional view of a toner conveying device 1*d* according to another embodiment. Similarly to FIG. 10, in FIG. 12, the −Y direction refers to the front and the +Y direction refers to the rear.

The toner conveying device 1*d* according to this embodiment includes a small-diameter pipe 61*a* having a constant diameter in the longitudinal direction and serving as a pipe body 61', a large-diameter pipe 61*b* having a constant diameter in the longitudinal direction and located midway of the small-diameter pipe 61*a* coaxially therewith, a small-diameter screw member 50*a* located in the small-diameter pipe 61*a* coaxially therewith, and a large-diameter screw member 50*b* located in the large-diameter pipe 61*b* coaxially therewith.

The small-diameter screw member 50*a* and the large-diameter screw member 50*b* form the screw member 50' according to this embodiment.

In the toner conveying device 1*d* according to this embodiment, the dimensions of the small-diameter spiral fin 52*a* and large-diameter spiral fin 52*b* are such that the distance between the inner circumferential surface of the small-diameter pipe 61*a* and the outer circumferential surface of the spiral fin of the small-diameter screw member 50*a* (small-diameter spiral fin 52*a*) (i.e., the gap distance d1) equals the distance between the inner circumferential surface of the large-diameter pipe 61*b* and the outer circumferential surface of the spiral fin of the large-diameter screw member 50*b* (large-diameter spiral fin 52*b*) (i.e., the gap distance d2) (d1=d2).

With the toner conveying device 1*d* according to this embodiment, even if the large-diameter pipe 61*b* is located midway of the pipe body 61' that is mainly formed of the small-diameter pipe 61*a*, because the distance between the outer circumferential surface of the spiral fin of the screw member 50' and the inner circumferential surface of the pipe body 61' is constant, toner does not deposit locally in the pipe body 61'.

The toner conveying devices 1*a*, 1*b*, 1*c*, and 1*d* according to the embodiments are used in the belt cleaning device 30 of the printer 10. However, the toner conveying devices 1*a*, 1*b*, 1*c*, and 1*d* of the present invention are not limited to use with the belt cleaning device 30, but may be used with, for example, a toner conveying path for conveying toner from the toner containers 135 to the developing devices 134.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A toner conveying device comprising:

a conveying pipe for feeding toner, an inside diameter thereof changing in a pipe-axis direction; and a conveying screw coaxially arranged in the conveying pipe, the conveying screw feeding toner by rotating about an axis, the conveying screw comprising: a screw shaft that rotates about the axis; and a spiral fin that is spirally formed around an outer circumferential surface of the screw shaft, and a distance between an outer circumferential surface of the spiral fin and an inner circumferential surface of the conveying pipe is substantially constant in the pipe-axis direction.

2. The toner conveying device according to claim 1, wherein the inside diameter of the conveying pipe gradually decreases from one end to the other end.

3. The toner conveying device according to claim 1, wherein the inside diameter of the conveying pipe gradually decreases from an upstream end toward a downstream end in a toner feeding direction.

4. The toner conveying device according to claim 1, wherein a spiral pitch of the spiral fin is substantially inversely proportional to the inside diameter of the conveying pipe.

5. The toner conveying device according to claim 1, wherein a diameter of the screw shaft changes with a change in the inside diameter of the conveying pipe.

6. The toner conveying device according to claim 1, wherein the conveying pipe includes a small-diameter pipe and a large-diameter pipe having a larger inside diameter than an inside diameter of the small-diameter pipe in a toner feeding direction.

7. The toner conveying device according to claim 6, wherein the small-diameter pipe has a small-diameter screw member, and the large-diameter pipe has a large-diameter screw member.

8. The toner conveying device according to claim 7, wherein the small-diameter screw member has a spiral fin having a diameter that is smaller than a diameter of a spiral fin of the large-diameter screw member.

9. An image forming apparatus comprising:

a toner conveying device comprising a conveying pipe for feeding toner, an inside diameter thereof changing in a pipe-axis direction, and a conveying screw coaxially arranged in the conveying pipe, the conveying screw feeding toner by a rotating about an axis, the conveying screw comprising: a screw shaft that rotates about the axis; and a spiral fin that is spirally formed around an outer circumferential surface of the screw shaft, and a distance between an outer circumferential surface of the spiral fin and an inner circumferential surface of the conveying pipe is substantially constant in the pipe-axis direction.

10. An image forming apparatus according to claim 9, comprising:

a cleaning device body including a toner removal means that removes residual toner from a surface of an image bearing member;

a collected toner reservoir for receiving collected toner from the cleaning device body;

the toner conveying device being disposed between the cleaning device body and the collected toner reservoir, for feeding the collected toner from the cleaning device body to the collected toner reservoir.

11. A method for conveying toner comprising:

feeding toner from a cleaning device body to a toner reservoir using a conveying pipe having an inside diameter that changes in a pipe-axis direction; and moving the toner in the conveying pipe using a conveying screw comprising a spiral fin wherein a distance between an outer circumferential surface of the spiral fin and an inner circumferential surface of the conveying pipe is substantially constant in the pipe-axis direction.

* * * * *